United States Patent [19]

Adams

[11] Patent Number: 4,967,878

[45] Date of Patent: Nov. 6, 1990

[54] BRACE FOR HORIZONTAL SCAFFOLD MEMBERS

[75] Inventor: Jerry S. Adams, Hammond, La.

[73] Assignee: Scaffold Services, Inc., Port Allen, La.

[21] Appl. No.: 436,238

[22] Filed: Nov. 14, 1989

[51] Int. Cl.[5] ..... E04G 7/06

[52] U.S. Cl. ..... 182/179; 52/638; 403/385

[58] Field of Search ..... 403/385, 386, 400; 52/638; 182/179, 178

[56] References Cited

U.S. PATENT DOCUMENTS

| | | | |
|---|---|---|---|
| 1,706,801 | 3/1929 | Merrill | 403/385 |
| 2,107,407 | 2/1938 | Burton | 403/385 |
| 4,858,861 | 8/1989 | Wilkinson | 403/386 |

FOREIGN PATENT DOCUMENTS

| | | | |
|---|---|---|---|
| 829602 | 4/1938 | France | 403/385 |
| 299291 | 8/1954 | Switzerland | 403/385 |
| 423146 | 1/1935 | United Kingdom | 403/385 |

*Primary Examiner*—Reinaldo P. Machado

*Attorney, Agent, or Firm*—William David Kiesel; Robert C. Tucker; Timothy J. Monahan

[57] ABSTRACT

A brace to reinforce the horizontal bearers of scaffolds is provided having a trough shaped rest mounted on a top edge of a planar bracket. The brace is held in place by support tubes extending upward from the scaffold posts. Clamps pivotally connected to each side of the bracket engage the ends of the support tubes.

10 Claims, 2 Drawing Sheets

BRACE FOR HORIZONTAL SCAFFOLD MEMBERS

BACKGROUND OF THE INVENTION

1. Field of the Invention

The invention relates generally to scaffolding couplers and particularly to a brace to reinforce the horizontal bearers upon which the scaffold boards lie.

2. Prior Art

Tube and coupler scaffolds are made up of vertical posts connected across the width of the scaffold by horizontal bearers and connected along the length of the scaffold by horizontal runners. Scaffold boards are placed on the bearers along the length of the scaffold. Cross bracing across the width of the scaffold and diagonal bracing along the length of the scaffold are added for reinforcement. Swivel clamps and right angle clamps are used to connect the tubes together.

The Occupational Safety and Health Administration (OSHA) and American National Standards Institute (ANSI) have promulgated rules regarding the maximum span allowed for bearers and runners in a scaffold. The maximum span for 2¼" O.D. steel tubing bearers is 6'. Recently, ANSI has recommended that the maximum span for bearers be limited to 4¼'. One likely effect of the recommendation being implemented will be to narrow the allowable width of scaffolds.

SUMMARY OF THE INVENTION

Therefore, one object of the invention is to provide intermediate reinforcement for bearer tubing to allow posts to be spaced up to nine feet apart.

Another object of the invention is to provide a reinforcing brace which does not interfere with the scaffold boards lying on the bearer.

Still another object of the invention is to provide a brace which is adjustable and can be disassembled along with the scaffold.

Accordingly, a brace for horizontal scaffold tubing is provided having a trough shaped rest positionable underneath the tubing. A planer shaped bracket having an edge connected to the bottom of the rest extends downward. The bracket is aligned with the horizontal tubing and has a tubing clamp pivotally connected to each side. Each clamp engages a diagonal support tube extending upward from an adjacent scaffold post.

DESCRIPTION OF THE PREFERRED EMBODIMENT OF THE INVENTION

Without limiting the scope of the invention, the preferred embodiment of the invention is hereinafter set forth.

Figure 1:
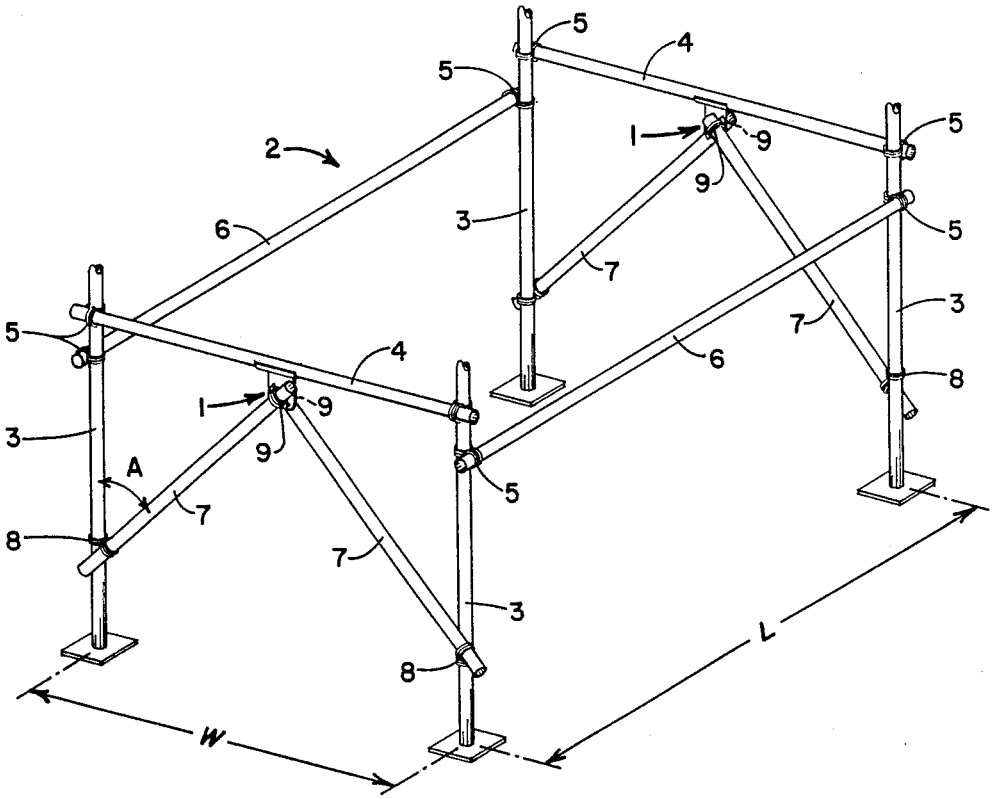
FIG. 1 is a perspective view of the brace.

Referring to FIG. 1, brace 1 is shown incorporated into a typical tube and coupler scaffold 2. Vertical posts 3 of scaffold 2 are spaced to form a rectangle having width "W" and length "L". Horizontal bearers 4 are connected to posts 3 with clamps 5 across the width of scaffold 2. Horizontal runners 6 connect posts 3 along the length of scaffold 2 and are likewise coupled with clamps 5.

Scaffold boards (not shown) are laid lengthwise on top of bearers 4 on scaffold 2. Bearers 4 must be able to withstand the weight of the scaffold boards and the weight of the persons, equipment and material placed on the scaffold. The amount of weight that bearers 4 can safely handle is a function of width W and the diameter and thickness of the tubes employed. Most commercial scaffolds are construct from 2" or 2¼" O.D. tubing having a 70,000 lb./sq.in. tensile strength and 50,000 lb./sq.in. yield strength.

Rather than narrow width W of scaffold 2, bearers 4 may be reinforced with brace 1. In FIG. 1, brace 1 is shown approximately midway between posts 3 underneath bearer 4. Support tubes 7 angle upward from posts 3 and meet at brace 1. Support tubes 7 are connected to posts 3 with swivel clamps 8 which can be pivoted to adjust the angle at which support tubes 7 rise. Angle "A", between a support tube 7 and the post 3 to which it is connected, is an acute angle. Support tubes 7 are engaged at their upper ends by clamps 9 on either side of brace 1.

Figure 2:
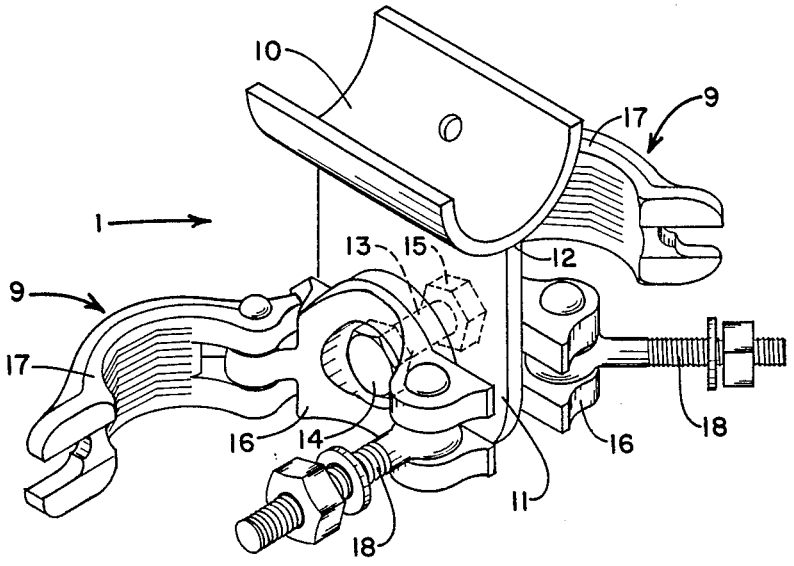
FIG. 2 is a perspective view of the brace showing an alternate embodiment of the tubing rest.
Figure 3:
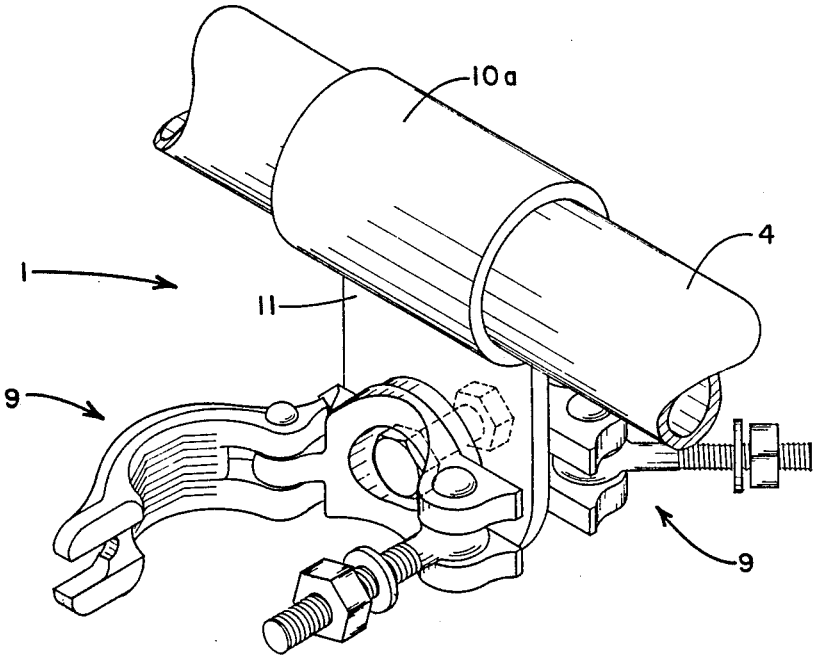
FIG. 3 is a perspective view of the brace incorporated into a scaffold.

Referring to FIG. 2, brace 1 is shown in detail. Brace 1 has rest 10 which is positioned on an underside of bearer 4. The trough shape of rest 10 prevents bearer 4 from flexing and slipping off of brace 1. Alternatively, the trough shaped portion of rest 10 could be extended to form sleeve 10*a* around bearer 4 as shown in FIG. 3. Sleeve 10*a* may be slid over an end of bearer 4 before bearer 4 is clamped to scaffold 2. Various other designs for rest 10 which would prevent bearer 4 from slipping off of brace 1 are intended to be within the scope of the invention.

Clamps 9 and rest 10 of brace are connected together by bracket 11. Bracket 11 is planar and has a top edge 12 connected to the exterior side of rest 10. The interior side of rest 10 is the side facing bearer 4. Bracket 11 is aligned with rest 10 and bearer 4 in that rest 10 and bearer 4 extend longitudinally in approximately the same plane or parallel to bracket 11. The orientation of bracket 11 allows clamps 9 to be placed on either side to receive support tubes 7 which extend upward from posts 3 approximately parallel to bracket 11.

Clamps 9 are pivotally connected to bracket 11 and each other with bolt 13. Bolt 13 extends through the base 16 of each of clamps 9. Head 14 on one end of bolt 13 and nut 15 (shown in FIG. 2) on the opposite end secure clamps 9.

The individual clamps 9 are known in the art and are employed for example in swivel clamps. In addition to base 16, clamps 9 have jaws 17 and eye bolt 18 to secure jaws 17.

There are of course many alternate embodiments and modifications of the invention which are intended to be included within the scope of the following claims.

What I claim is:

1. In combination with a scaffold having a first vertical post, a second vertical post and a horizontal bearer connecting said first and second posts, a brace comprising:

(a) a rest supporting an underside of the center portion of said horizontal member, said rest having an interior side positionable in contact with said horizontal member and an exterior side, (b) a bracket extending downward from and connected to said exterior side, (c) a first clamp pivotally connected to said bracket, in a position whereby its uppermost part is below said horizontal bearer, (d) a second clamp pivotally connected to said bracket in a position whereby its uppermost part is below said horizontal bearer, (e) a first elongated member having a lower end connected to said first post and an upper end engaged by said first clamp; and (f) a second elongated member having a lower end connected to said second post and an upper end engaged by said second clamp.

2. A brace according to claim 1, wherein said bracket extends downward from a bottom portion of said exterior side.

3. A brace according to claim 2 wherein said first and second clamps are positioned on opposite sides of said bracket.

4. A brace according to claim 3 wherein said first and second clamps are pivotally connected to said bracket by a bolt extending perpendicularly through said bracket.

5. A brace according to claim 2 wherein said first and second members are of sufficient length to allow said rest to be positioned approximately midway between said first and second posts.

6. A brace according to claim 2 wherein said first and second clamps are tube clamps and said first and second members are tubular.

7. In combination with as scaffold having a first vertical post, a second vertical post and a horizontal bearer connecting said first and second posts, a brace comprising:

(a) a rest having a trough shaped portion positioned only against the underside surface of said horizontal member, (b) a bracket extending downward from and connected to said exterior side, (c) a first clamp pivotally connected to said bracket, in a position whereby its uppermost part is below said horizontal bearer, (d) a second clamp pivotally connected to said bracket in a position whereby its uppermost part is below said horizontal bearer, (e) a first elongated member having a lower end connected to said first post and an upper end engaged by said first clamp; and (f) a second elongated member having a lower end connected to said second post and an upper end engaged by said second clamp.

8. In combination with a scaffold having a first vertical post, a second vertical post and a horizontal bearer connecting said first and second posts, a brace according to claim 7 wherein said trough shaped portion of said rest has a semicircular cross-section.

9. In combination with a scaffold having a first vertical post, a second vertical post and a horizontal bearer connecting said first and second posts, a brace according to claim 7 wherein the uppermost part of said rest in operatively positioned below the uppermost part of said horizontal bearer.

10. In combination with a scaffold having a first vertical post, a second vertical post and a horizontal bearer connecting said first and second posts, a brace according to claim 7 wherein said rest is positioned about equal distant from said vertical members to which said horizontal member is attached.

* * * * *